US009168438B2

(12) United States Patent
Boyd

(10) Patent No.: US 9,168,438 B2
(45) Date of Patent: Oct. 27, 2015

(54) GOLF CLUB AND GOLF CLUB HEAD STRUCTURES

(71) Applicant: Nike, Inc., Beaverton, OR (US)

(72) Inventor: Robert Boyd, Euless, TX (US)

(73) Assignee: NIKE, Inc, Beaverton, OR (US)

( * ) Notice: Subject to any disclaimer, the term of this patent is extended or adjusted under 35 U.S.C. 154(b) by 0 days.

(21) Appl. No.: 13/799,354

(22) Filed: Mar. 13, 2013

(65) Prior Publication Data

US 2013/0190105 A1 Jul. 25, 2013

Related U.S. Application Data

(60) Division of application No. 12/723,951, filed on Mar. 15, 2010, which is a continuation-in-part of application No. 12/356,176, filed on Jan. 20, 2009, now Pat. No. 7,922,603.

(51) Int. Cl.

| | |
|---|---|
| ***A63B 53/04*** | (2015.01) |
| ***A63B 53/06*** | (2015.01) |
| ***A63B 59/00*** | (2015.01) |
| ***A63B 69/36*** | (2006.01) |

(52) U.S. Cl.

CPC ..... *A63B 53/06* (2013.01); *A63B 53/04* (2013.01); *A63B 53/0466* (2013.01); *A63B 59/0074* (2013.01); *A63B 69/3632* (2013.01); *A63B 59/0088* (2013.01); *A63B 69/3685* (2013.01); *A63B 2053/0416* (2013.01); *A63B 2053/0433* (2013.01); *A63B 2053/0441* (2013.01); *A63B 2053/0491* (2013.01); *A63B 2225/01* (2013.01)

(58) Field of Classification Search

USPC ..... 473/324–350

See application file for complete search history.

(56) References Cited

U.S. PATENT DOCUMENTS

| | | | | |
|---|---|---|---|---|
| 1,916,792 | A | 7/1933 | William | |
| 2,041,676 | A | 5/1936 | Gallagher | |
| 3,170,698 | A | 2/1965 | Schoeffler et al. | |
| 3,966,210 | A * | 6/1976 | Rozmus | 473/341 |
| 3,976,299 | A | 8/1976 | Lawrence et al. | |
| 4,291,883 | A | 9/1981 | Smart et al. | |

(Continued)

FOREIGN PATENT DOCUMENTS

| | | |
|---|---|---|
| EP | 2377586 A2 | 10/2011 |
| GB | 2422554 A | 8/2006 |

(Continued)

OTHER PUBLICATIONS

International Search Report and Written Opinion issued Jul. 7, 2010 in corresponding PCT Application No. PCT/US2010/021355.

(Continued)

*Primary Examiner* — Alvin Hunter

(74) *Attorney, Agent, or Firm* — Banner & Witcoff, Ltd.

(57) ABSTRACT

Golf club and golf club head structures having a void formed in the golf club head body are presented. In some arrangements, the golf club head may include a first arm and a second arm extending rearward from the golf club head body defining the void. In some examples, the golf club head body, first arm and second arm may form a substantially V-shaped golf club head. In other arrangements, the golf club head body may have a portion of the body removed to form a void defined by the golf club head body. In some arrangements, the void may be substantially T-shaped and may include a void insert.

10 Claims, 11 Drawing Sheets

(56) References Cited

U.S. PATENT DOCUMENTS

| | | | | | |
|---|---|---|---|---|---|
| 4,871,174 | A | * | 10/1989 | Kobayashi | 473/252 |
| 4,895,371 | A | | 1/1990 | Bushner | |
| 4,898,387 | A | * | 2/1990 | Finney | 473/341 |
| 5,211,401 | A | | 5/1993 | Hainey | |
| 5,253,869 | A | | 10/1993 | Dingle et al. | |
| 5,340,104 | A | | 8/1994 | Griffin | |
| D354,103 | S | | 1/1995 | Allen | |
| 5,407,196 | A | | 4/1995 | Busnardo | |
| 5,429,366 | A | | 7/1995 | McCabe | |
| D363,749 | S | | 10/1995 | Kenmi | |
| 5,464,217 | A | | 11/1995 | Shenoha et al. | |
| 5,467,988 | A | | 11/1995 | Henwood | |
| 5,489,097 | A | * | 2/1996 | Simmons | 473/326 |
| 5,497,995 | A | | 3/1996 | Swisshelm | |
| 5,516,106 | A | | 5/1996 | Henwood | |
| D372,063 | S | | 7/1996 | Hueber | |
| 5,533,725 | A | * | 7/1996 | Reynolds, Jr. | 473/307 |
| D375,987 | S | | 11/1996 | Lin | |
| 5,580,058 | A | * | 12/1996 | Coughlin | 273/250 |
| 5,607,365 | A | | 3/1997 | Wolf | |
| 5,692,968 | A | | 12/1997 | Shine | |
| 5,709,613 | A | | 1/1998 | Sheraw | |
| D392,007 | S | | 3/1998 | Fox | |
| D397,387 | S | | 8/1998 | Allen | |
| D398,946 | S | | 9/1998 | Kenmi | |
| 5,820,481 | A | | 10/1998 | Raudman | |
| 5,888,148 | A | | 3/1999 | Allen | |
| D414,234 | S | | 9/1999 | Darrah | |
| 5,947,841 | A | * | 9/1999 | Silvestro | 473/341 |
| 6,015,354 | A | | 1/2000 | Ahn et al. | |
| 6,270,422 | B1 | | 8/2001 | Fisher | |
| RE37,647 | E | | 4/2002 | Wolf | |
| 6,394,910 | B1 | * | 5/2002 | McCarthy | 473/251 |
| 6,402,638 | B1 | | 6/2002 | Kelley | |
| D465,251 | S | | 11/2002 | Wood et al. | |
| 6,558,271 | B1 | | 5/2003 | Beach et al. | |
| 6,634,956 | B1 | * | 10/2003 | Pegg | 473/251 |
| 6,652,390 | B2 | * | 11/2003 | Bradford | 473/341 |
| 6,663,503 | B1 | | 12/2003 | Kenmi | |
| 6,767,292 | B1 | | 7/2004 | Skalla, Sr. | |
| D498,508 | S | | 11/2004 | Antonious | |
| 6,878,071 | B1 | | 4/2005 | Schwieger et al. | |
| 6,991,555 | B2 | | 1/2006 | Reese | |
| 7,018,304 | B2 | * | 3/2006 | Bradford | 473/334 |
| 7,070,515 | B1 | | 7/2006 | Liu | |
| 7,147,569 | B2 | | 12/2006 | Tang et al. | |
| 7,163,470 | B2 | | 1/2007 | Galloway et al. | |
| 7,201,668 | B1 | * | 4/2007 | Pamias | 473/288 |
| 7,255,653 | B2 | | 8/2007 | Saso | |
| 7,297,073 | B2 | | 11/2007 | Jung | |
| 7,326,121 | B2 | | 2/2008 | Roake | |
| 7,396,289 | B2 | * | 7/2008 | Soracco et al. | 473/251 |
| 7,407,443 | B2 | | 8/2008 | Franklin et al. | |
| 7,431,660 | B2 | * | 10/2008 | Hasegawa | 473/251 |
| 7,431,663 | B2 | * | 10/2008 | Pamias | 473/288 |
| 7,520,820 | B2 | | 4/2009 | Dimarco | |
| 7,713,138 | B2 | | 5/2010 | Sato et al. | |
| 7,717,803 | B2 | * | 5/2010 | DiMarco | 473/334 |
| 7,722,478 | B2 | * | 5/2010 | Ebner | 473/335 |
| 7,771,285 | B2 | | 8/2010 | Porter | |
| 7,803,066 | B2 | | 9/2010 | Solheim et al. | |
| 7,846,036 | B2 | * | 12/2010 | Tanaka | 473/286 |
| 7,918,745 | B2 | * | 4/2011 | Morris et al. | 473/252 |
| 7,922,596 | B2 | | 4/2011 | Vanderbilt et al. | |
| 7,922,603 | B2 | | 4/2011 | Boyd et al. | |
| 7,959,519 | B2 | | 6/2011 | Zielke et al. | |
| 7,993,211 | B2 | | 8/2011 | Bardha | |
| 7,993,213 | B1 | | 8/2011 | D'Eath | |
| 8,025,586 | B2 | | 9/2011 | Teramoto | |
| 8,100,779 | B2 | | 1/2012 | Solheim et al. | |
| 8,251,836 | B2 | | 8/2012 | Brandt | |
| 8,272,974 | B2 | | 9/2012 | Mickelson et al. | |
| 8,282,506 | B1 | | 10/2012 | Holt | |
| 8,308,583 | B2 | * | 11/2012 | Morris et al. | 473/335 |
| 8,353,782 | B1 | | 1/2013 | Beach et al. | |
| D675,691 | S | | 2/2013 | Oldknow et al. | |
| D676,512 | S | | 2/2013 | Oldknow et al. | |
| D676,909 | S | | 2/2013 | Oldknow et al. | |
| D676,913 | S | | 2/2013 | Oldknow et al. | |
| D676,914 | S | | 2/2013 | Oldknow et al. | |
| D676,915 | S | | 2/2013 | Oldknow et al. | |
| D677,353 | S | | 3/2013 | Oldknow et al. | |
| 2003/0045371 | A1 | | 3/2003 | Wood | |
| 2003/0054900 | A1 | | 3/2003 | Tindale | |
| 2005/0137024 | A1 | | 6/2005 | Stites et al. | |
| 2005/0227780 | A1 | * | 10/2005 | Cover et al. | 473/334 |
| 2006/0040765 | A1 | | 2/2006 | Sano | |
| 2007/0149309 | A1 | | 6/2007 | Ford | |
| 2007/0225085 | A1 | | 9/2007 | Koide et al. | |
| 2008/0146370 | A1 | | 6/2008 | Beach et al. | |
| 2008/0171610 | A1 | | 7/2008 | Shin | |
| 2009/0163294 | A1 | | 6/2009 | Cackett et al. | |
| 2009/0186717 | A1 | | 7/2009 | Stites et al. | |
| 2010/0190573 | A1 | | 7/2010 | Boyd | |

FOREIGN PATENT DOCUMENTS

| | | | | | |
|---|---|---|---|---|---|
| JP | S5163452 | U | | 5/1976 | |
| JP | 07-255886 | | | 10/1995 | |
| JP | 07255886 | A | * | 10/1995 | A63B 53/04 |
| JP | 07275407 | | | 10/1995 | |
| JP | 09-047528 | | | 2/1997 | |
| JP | 09047528 | | | 2/1997 | |
| JP | 10277180 | A | * | 10/1998 | |
| JP | 10305119 | A | * | 11/1998 | A63B 53/04 |
| JP | 2000271253 | A | * | 10/2000 | A63B 53/04 |
| JP | 2002306647 | A | * | 10/2002 | A63B 53/04 |
| JP | 2006223701 | A | * | 8/2006 | |
| JP | 2007209722 | A | * | 8/2007 | |
| JP | 2008036315 | | | 2/2008 | |
| JP | 2009201744 | A | * | 9/2009 | |
| TW | 498774 | | | 8/2002 | |
| TW | 292575 | | | 1/2008 | |
| TW | 309777 | | | 5/2009 | |
| WO | 2005035073 | A1 | | 4/2005 | |
| WO | 2005058427 | A1 | | 6/2005 | |
| WO | 2005079933 | A1 | | 9/2005 | |
| WO | 2009091636 | | | 7/2009 | |
| WO | 2010090814 | | | 8/2010 | |

OTHER PUBLICATIONS

Invitation to Pay Additional Fees and Partial Search Report issued Apr. 12, 2010 in corresponding PCT Application PCT/US2010/021355.

International Search Report and Written Opinion issued Sep. 9, 2011 in corresponding PCT Application No. PCT/US2011/023678.

U.S. Appl. No. 13/746,043, Office Action Mailed Mar. 28, 2013.

PCT/US2013/025615, International Search Report and Written Opinion, mailed Aug. 14, 2013.

U.S. Appl. No. 13/746,043, Office Action mailed Sep. 11, 2013.

Japanese Patent Application No. 2013-5000052, Notice of Reasons for Rejection, dated Jan. 20, 2014.

U.S. Appl. No. 12/723,951, Office Action dated May 2, 2013.

U.S. Appl. No. 12/723,951, Office Action Nov. 23, 2012.

U.S. Appl. No. 12/723,951, Office Action dated Dec. 4, 2013.

EP Application 10700927.6, Communication Pursuant to Article 94(3) EPC, dated Apr. 12, 2013.

TW Patent Application 100104424, Search Report, dated Aug. 7, 2013.

PCT/US2013/061812, International Search Report and Written Opinion, mailed Mar. 24, 2014.

* cited by examiner

GOLF CLUB AND GOLF CLUB HEAD STRUCTURES

CROSS REFERENCE TO RELATED APPLICATIONS

This U.S. patent application is a divisional of U.S. patent application Ser. No. 12/723,951 filed Mar. 15, 2010, and entitled "Golf Club and Golf Club Head Structures" which is a continuation-in-part of U.S. patent application Ser. No. 12/356,176, filed Jan. 20, 2009 and entitled "Golf Club Assembly and Golf Club Head with Bar and Weighted Member," which is incorporated herein in its entirety by reference and upon which a claim of priority is made.

TECHNICAL FIELD

Aspects of this invention relate generally to golf clubs and golf club heads, and, in particular, to golf clubs and golf club heads having a portion of the club head removed, thereby creating a void in the club head, in order to reduce weight associated with the club head.

BACKGROUND

Golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

The performance of a golf club can vary based on several factors, including weight distribution about the head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, including ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively.

Altering the moment of inertia can also affect how the golf club performs including how the golf club head design impacts heel and toe mishits. Similarly, other factors such as point of impact and launch angle can also affect how the ball travels once it has been struck.

Club designers are often looking for new ways to redistribute weight associated with a golf club and/or golf club head. For instance, club designers are often looking to distribute weight to provide more forgiveness in a club head, improved accuracy, and the like. Accordingly, it would be advantageous to provide a golf club head having a reduced weight characteristics and improved distribution of weight throughout the club head.

SUMMARY

The principles of the invention may be used to provide a golf club head with a bar and weighted member that can be selectively adjusted by a user. In accordance with a first aspect, a golf club head includes a body having a first arm and a second arm extending outwardly therefrom. A bar has a first end connected to a free end of the first arm and a second end connected to a free end of the second arm. A weighted member is positioned along the bar.

In accordance with another aspect, a golf club head includes a body defining a first arm and a second arm. A sole plate extends between the first arm and the second arm. A bar has a first end connected to a free end of the first arm and a second end connected to a free end of the second arm. A weighted member is movable along the bar.

In accordance with a further aspect, a golf club assembly includes a shaft; and a club head secured to the first end of the shaft. The club head includes a body having a first arm and a second arm extending outwardly therefrom. A bar has a first end connected to a free end of the first arm and a second end connected to a free end of the second arm. A weighted member is positioned along the bar.

Substantial advantage can be achieved by providing a golf club head with a bar and weighted member on the bar. In particular, certain embodiments allow a user to individually customize the mass properties of the head, thereby optimizing the performance of the club head for the user's swing.

Additional aspects of the disclosure relate to a golf club head having a golf club head body and a first arm and a second arm extending from a rear face of the club head body. The golf club head body, first arm and second arm form a substantially V-shaped golf club head and define a void within a rear region of the golf club head.

Still other aspects of the invention relate to a golf club head having a front face, a rear edge, a toe edge and a heel edge and a void formed within a central region of the golf club head. The void may extend from the rear edge toward the central region and may, in some arrangements, be T-shaped.

These and additional features and advantages disclosed here will be further understood from the following detailed disclosure of certain embodiments.

Figure 1:
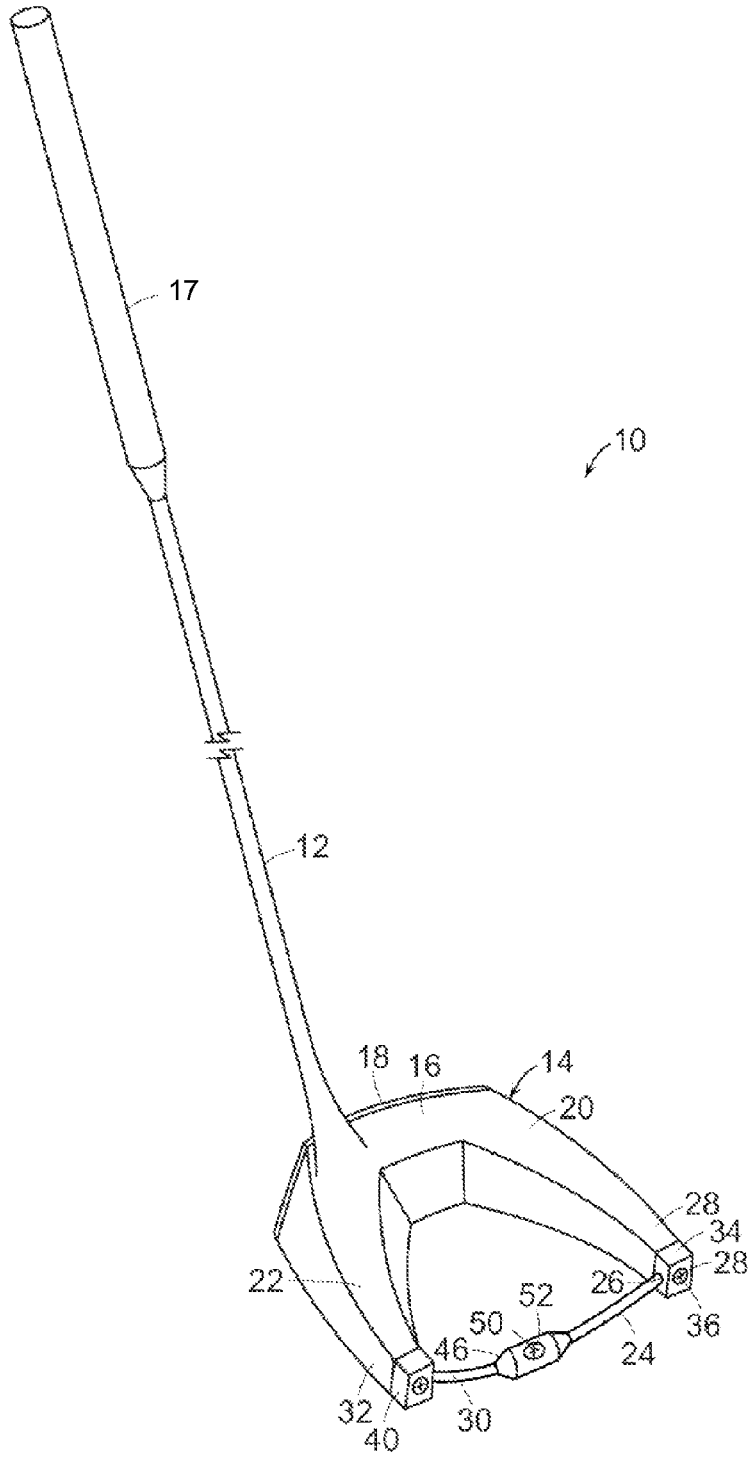
FIG. 1 is a perspective view of a golf club with a bar and weighted member according to an illustrative aspect.

The figures referred to above are not drawn necessarily to scale, should be understood to provide a representation of particular embodiments of the invention, and are merely conceptual in nature and illustrative of the principles involved. Some features of the golf club and golf club head structures depicted in the drawings have been enlarged or distorted relative to others to facilitate explanation and understanding. The same reference numbers are used in the drawings for similar or identical components and features shown in various alternative embodiments. Golf clubs and golf club head structures as described herein may have configurations and components determined, in part, by the intended application and environment in which they are used.

DETAILED DESCRIPTION

A. General Description of an Illustrative Golf Club with Golf Club Head Structure In general, as described above, aspects of this invention relate to a golf club or golf club head structures. More detailed descriptions of aspects of this invention follow.

1. Example Golf Clubs and Golf Club Head Structures Having a Void Defined by at Least a Portion of the Golf Club Head Aspects of this invention relate to golf clubs and golf club head structures. In at least some examples, the golf club head may include a golf club head body including a front portion, a rear portion opposite the front portion, a toe edge and a heel edge. The golf club head may further include a first arm extending rearward from the rear portion of the golf club head body, and a second arm extending rearward from the rear portion of the golf club head body. In some arrangements, the golf club head body, first arm and second arm may define a void in the golf club head.

Other aspects of the invention relate to golf club heads including a golf club head body having a front face, a rear face located opposite the front face, a toe edge and a heel edge. The golf club head may further include a first arm extending rearward from the rear face of the golf club head body and from the toe edge and a second arm extending rearward from the rear face of the golf club head body and from the heel edge. In some examples, the golf club head may further include a movable weight positioned within at least one of the first arm and the second arm. The movable weight may, in some arrangements, be slidable along a slot or groove formed in the first arm or second arm. In other examples, the weight may be removable.

Still other aspects of the invention relate to golf club heads including a golf club head body having a front face, a rear edge, a toe edge and a heel edge. The golf club head may further include a void formed in a central region of the golf club head body and extending from a rear edge inward, toward the front face of the golf club head body. In at least some examples, the void extends entirely through the golf club head body. Additionally or alternatively, the void may be substantially T-shaped.

In still other examples, the golf club head may include a golf club head body having a front face, a rear edge, a toe edge and a heel edge. The golf club head may further include a void formed in a central region of the golf club head. In at least some arrangements, the golf club head may further include a void insert shaped to correspond to the void and to be received within the void. The void insert may include a plurality of apertures defined by the void insert and extending at least partially through the void insert.

Still other aspects of the invention relate to a golf club including a shaft and a golf club head connected to one end of the shaft. In at least some examples, the golf club head may include a golf club head body having a front face, a rear face opposite the front face, a heel edge and a toe edge. The golf club head may further include a first arm extending rearward from the rear face at the toe edge of the club head body and a second arm extending rearward from the rear face at a heel edge of the club head body. In some arrangements, the golf club head may include a weight member connected to a free end of at least one of the first arm and the second arm.

Additional aspects and specific examples of the articles described above will be described in detail more fully below. The reader should understand that these specific examples are set forth merely to illustrate examples of the invention, and they should not be construed as limiting the invention.

B. Specific Examples of the Invention

In the following description of various example structures in accordance with the invention, reference is made to the accompanying drawings, which form a part hereof, and in which are shown by way of illustration various example articles, including one or more golf club or golf club head structures. Additionally, it is to be understood that other specific arrangements of parts and structures may be utilized and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention. Further, the invention generally will be described as it relates to wood-type golf clubs. However, aspects of the invention may be used with any of several types of golf clubs, including hybrid type golf clubs, utility clubs, and the like and nothing in the specification or figures should be construed to limit the invention to use with the wood-type golf clubs described.

An illustrative embodiment of a golf club 10 is shown in FIG. 1 and includes a shaft 12 and a golf club head 14 attached to shaft 12. Golf club head 14 may be any driver, wood, or the like. Shaft 12 of golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 17 is positioned on shaft 12 to provide a golfer with a slip resistant surface with which to grasp golf club shaft 12. Grip element 17 may be attached to shaft 12 in any desired manner, including in conventional manners known and used in the art (e.g., via adhesives or cements, via threads or other mechanical connectors, via fusing techniques, via friction fits, via retaining element structures, etc.).

Club head 14 may, in some arrangements, include a plurality of components. As illustrated, this example golf club head 14 includes a body member 16 and a face plate 18 positioned on a front surface of body member 16. A first arm 20 and a second arm 22, spaced from first arm 20, extend rearwardly from body member 16 defining between the arms a space 23 that extends through club head 14. In the illustrated embodiment, body member 16, first arm 20, and second arm 22 cooperate to form a substantially V-shaped club head 14.

A bar 24 has a first end 26 connected to a free end 28 of first arm 20, and a second end 30 connected to a free end 32 of second arm 22 such that bar 24 extends between first arm 20 and second arm 22. In certain embodiments, bar 24 is curved. In the embodiment illustrated in FIG. 1, bar 24 is curved outwardly away from free ends 28 and 32 of first and second arms 20, 22, respectively, in a direction extending away from body member 16 and face plate 18.

In the illustrated embodiment a first mounting member 34 is connected to first end 26 of bar 24. A first aperture 36 extends through first mounting member 34, and a fastener, such as first screw 38 extends through first aperture 36 and secures first mounting member 34 to first arm 20.

Similarly, a second mounting member 40 is connected to second end 30 of bar 24. A second aperture 42 extends through second mounting member 40, and a fastener, such as second screw 44 extends through second aperture 42 and secures second mounting member 40 to second arm 22.

In the illustrated embodiment, bar 24 has a substantially cylindrical cross-section. It is to be appreciated that bar 24 can have another cross-section such as rectangular, triangular, or any other desired cross-section. Bar 24 may be formed of various materials, such as steel, aluminum, titanium, graphite, or composite materials, as well as alloys and/or combinations thereof, including materials that are conventionally known and used in the art.

A weighted member 46 is positioned on and movable along bar 24. Weighted member 46 has a central aperture 48 extending therethrough. In the illustrated embodiment, with bar 24 having a substantially cylindrical cross-section, central aperture 48 is substantially cylindrical. It is to be appreciated that central aperture 48 would have a shape mating with that of the cross-section of bar 24.

In certain embodiments, a fastener such as a set screw 50 extends through an aperture 52 formed in weighted member 46 to secure weighted member 46 to bar 24. Thus, weighted member 46 can be moved to any desired position along bar 24 and secured in that desired position with set screw 50, or any other suitable fastener. By positioning weighted member 46 at different positions along bar 24, the performance of club head can be altered and optimized to accommodate the swing of a particular golfer, and can be changed for a particular golfer as their swing changes over time. By moving weighted member 46, the center of gravity of the club can be altered, provide a club head that is more toe-weighted or heel-weighted, as well as moving the center of gravity closer to or further away from face plate 18.

Weighted member 46 may be formed of various materials, such as steel, aluminum, titanium, graphite, or composite materials, as well as alloys and/or combinations thereof, including materials that are conventionally known and used in the art.

Figure 2:
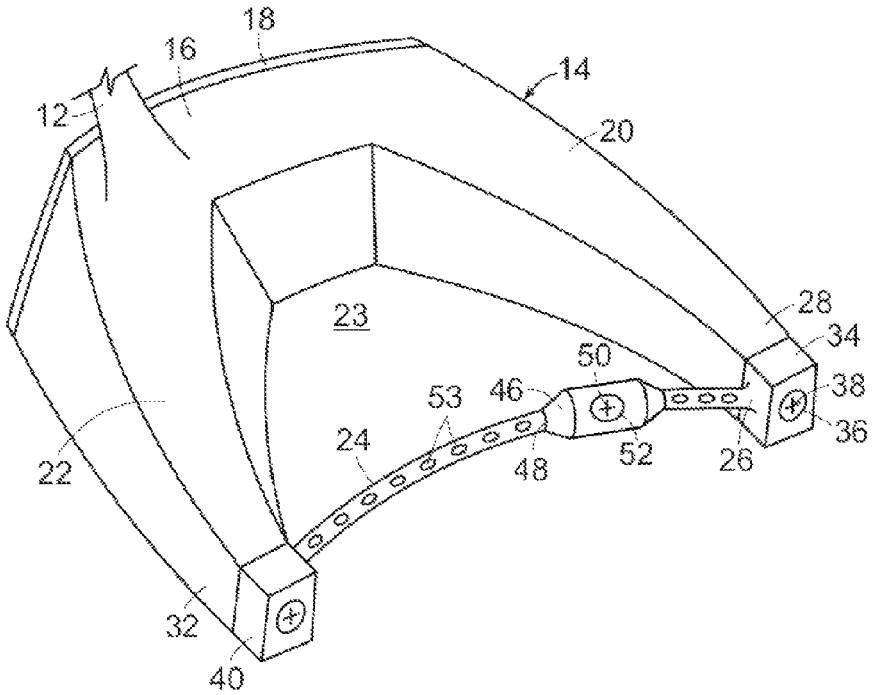
FIG. 2 is a perspective view of an alternative embodiment of the club head of the golf club of FIG. 1.

In certain embodiments, as illustrated in FIG. 2, bar 24 may be curved inwardly toward body member 16 and face plate 18. Additionally, a plurality of recesses 53 may be formed along bar 24, each of which is sized to accommodate set screw 50, thereby providing an improved registration of weighted member with respect to bar 24. Recesses 53 provide a limited number of positions at which weighted member 46 may be secured along bar 24. It is to be appreciated that other fasteners may be used to removably secure weighted member 46 to bar 24, such as pins, fasteners with a ball and mating recesses, or other detent mechanisms. Other suitable fasteners for removably securing weighted member 46 to bar 24 will become readily apparent to those skilled in the art, given the benefit of this disclosure.

Figure 3:
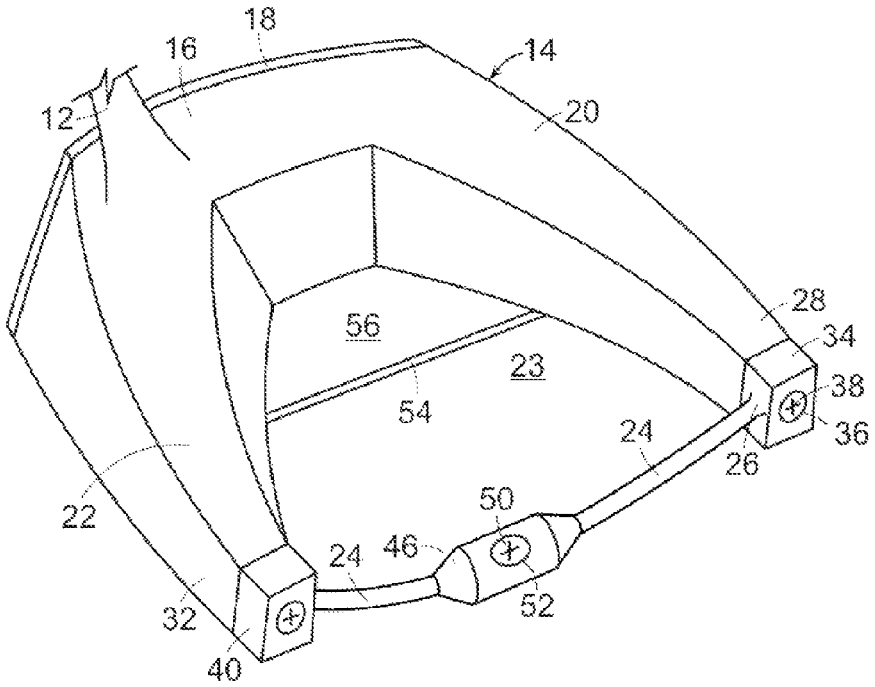
FIG. 3 is a perspective view of another alternative embodiment of the club head of the golf club of FIG. 1, showing a sole plate on a bottom of the club head.

In certain embodiments, as illustrated in FIG. 3, a sole plate 54 may be included in club head 14. Sole plate 54 is secured to a bottom surface of body 16 of club head 14, and extends laterally across club head 14 between first arm 20 and second arm 22. Sole plate 54 may be formed of the same material as body 16 or any other desired material.

Sole plate 54 may extend rearwardly from a front edge of club head 14 along only a portion of first arm 20 and second arm 22. In the illustrated example, sole plate 54 extends rearwardly to approximately a midpoint or central portion of each of first arm 20 and second arm 22. In such an embodiment, an upper surface 56 of sole plate 54 is exposed to an exterior of club head 14 through space 23 formed between first arm 20 and second arm 22. The remainder of space 23 rearwardly of sole plate 54 is unobstructed and provides a clear path vertically through club head 14. The inclusion of sole plate 54 provides a club head for a driver that conforms to the current requirements of the United States Golf Association.

Figure 4:
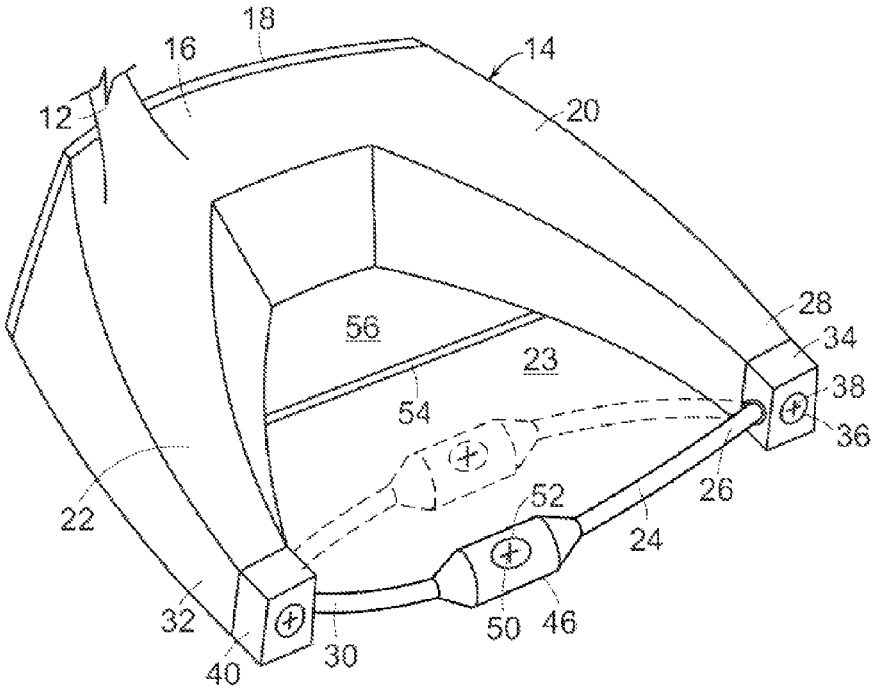
FIG. 4 is a perspective view of yet another alternative embodiment of the club head of the golf club of FIG. 1, showing the bar being pivotable with respect to the head.

Another embodiment is illustrated in FIG. 4 in which bar 24 is pivotable with respect to first arm 20 and second arm 22. In this embodiment, as shown by the solid lines, bar 24 can be pivoted to a point where it curves outwardly away from body 16. Bar 24 can also be pivoted, as shown in dashed lines, such that it curves inwardly toward body 16. In such an embodiment, first end 26 of bar 24 may be pivotally received in a first aperture 58 formed in first mounting member 34, and second end 30 of bar 24 may be pivotally received in a corresponding second aperture (not visible) in second mounting member 40. In other embodiments, first aperture 58 may be formed directly in free end 28 of first arm 20 and the corresponding second aperture. It is to be appreciated in certain embodiments, bar 24 may be temporarily fixed with respect to body 16 once it has been pivoted to a desired position by a detent mechanism or any other means, and other suitable means will become readily apparent to those skilled in the art, given the benefit of this disclosure. Providing bar 24 with the ability to pivot allows the center of gravity of club head 14 to be moved closer to, or further away from face plate 18.

Figure 5:
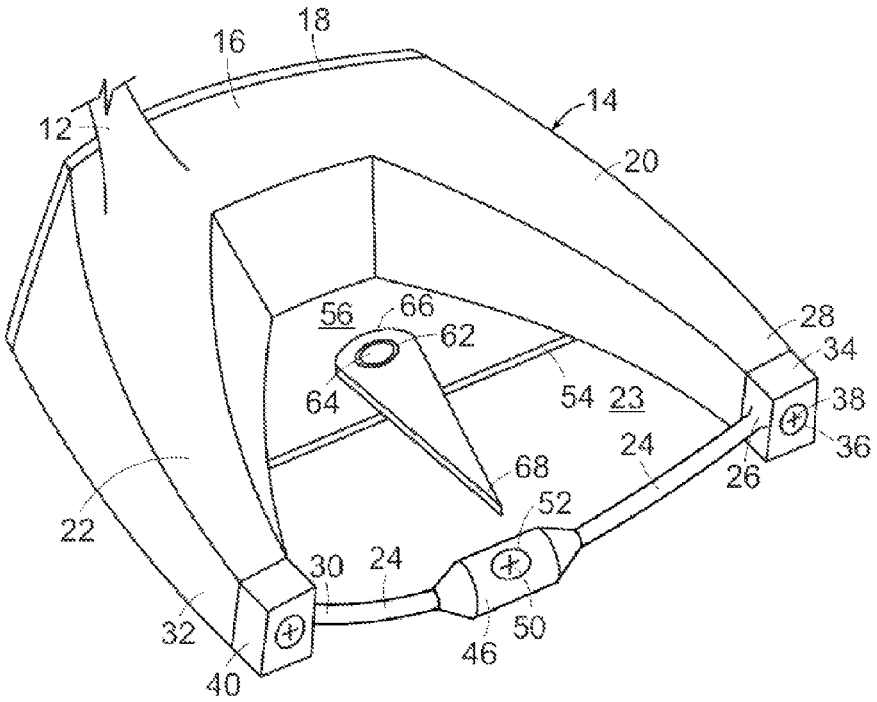
FIG. 5 is a perspective view of a further alternative embodiment of the club head of the golf club of FIG. 1, showing an indicator on a sole plate of the head.

Another embodiment is shown in FIG. 5, in which a movable indicator 60 is located on club head 14. In the illustrated embodiment indicator 60 is positioned on upper surface 56 of sole plate 54. In certain embodiments, an aperture 62 in indicator 60 receives and pivots about a pin or post 64 extending upwardly from upper surface 56 of sole plate 54. Movable indicator 60 can be pivoted by the user to a desired position to assist the user in aligning their golf shot. In the illustrated embodiment in FIG. 5 a first end 66 of indicator 60 is hemispherical in shape and contains aperture 62, with a second end 68 tapering to a point as it extends away from first end 66. It is to be appreciated that indicator 60 can be made of any desired material, and may be formed of the same material as that of body 16, or any other material.

Figure 6:
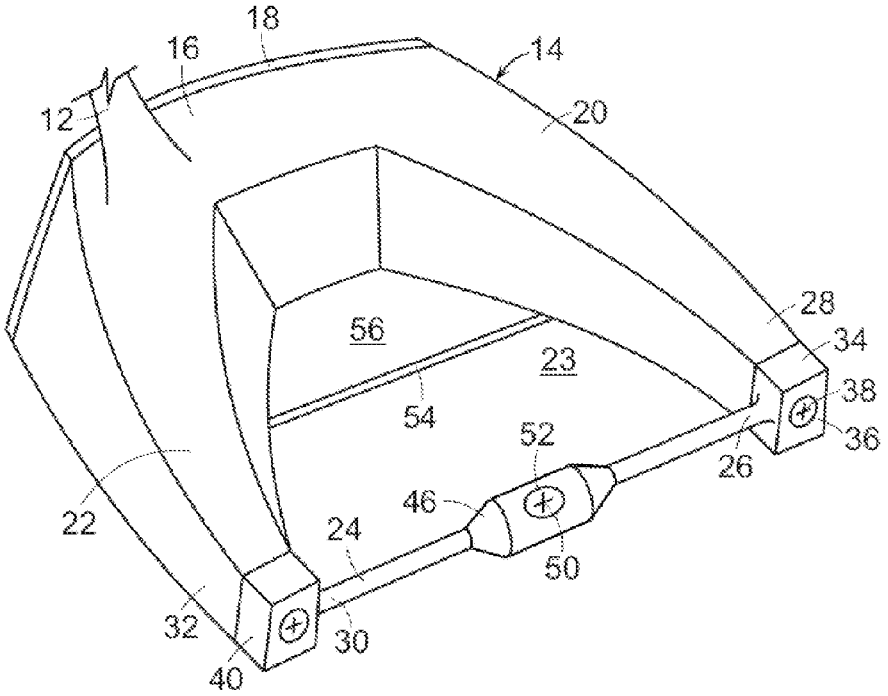
FIG. 6 is a perspective view of yet a further alternative embodiment of the club head of the golf club of FIG. 1, showing a straight bar.

Another embodiment is illustrated in FIG. 6 in which bar 24 extends straight between first arm 20 and second arm 22 rather than being curved between the arms. Such an embodiment allows the center of gravity of club head 14 to be moved laterally along club head 14 between a toe-weighted position and a heel-weighted position, while maintaining the distance between the center of gravity and face plate 18.

Figure 7:
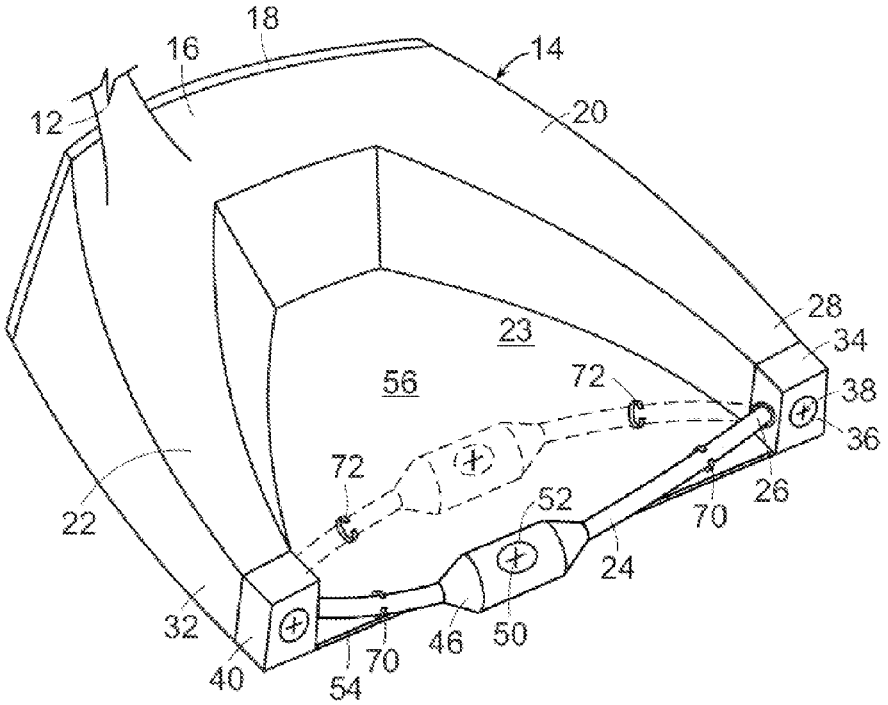
FIG. 7 is a perspective view of yet another alternative embodiment of the club head of the golf club of FIG. 1, showing the bar clipped to a sole plate of the club head.

Yet another embodiment is shown in FIG. 7, in which sole plate 56 extends rearwardly to the free ends 28 and 32 of first arm 20 and second arm 22, respectively. In this embodiment, bar 24 pivots with respect to first arm 20 and second arm 22, and retaining members are used to removably secure bar 24 to sole plate 56. In the illustrated example, a pair of first retaining members 70 in the form of first spring clips 70 are secured to upper surface 56 of sole plate 54, and serve to releasably receive bar 24 when bar 24 is in a forwardly rotated position, thereby releasably securing bar 24 to sole plate 54. A pair of second retaining members 72 in the form of second spring clips 72 are secured to upper surface 56 of sole plate 54, and serve to releasably receive bar 24 when bar 24 is in a rearwardly rotated position, thereby releasably securing bar 24 to sole plate 54. Releasably securing bar 24 to sole plate 54 with first and second retaining members 70, 72 may help enhance the rigidity of club head 14.

As noted above, in the illustrated embodiment a pair of first retaining members 70 and a pair of second retaining members 72 are used to releasably secure bar 24 to sole plate 54. However, it is to be appreciated that in other embodiments, a single first retaining member and single may be used to releasably secure bar 24 to sole plate 54. In yet other embodiments, more than two first retaining members and more than two second retaining members may be used to secure bar 24 to sole plate 54.

Although spring clips are illustrated here for first and second retaining members 70, 72, it is to be appreciated that any suitable retaining member may be used to releasably secure bar 24 to sole plate 54. Other suitable configurations and constructions for retaining members 70, 72 will become readily apparent to those skilled in the art, given the benefit of this disclosure.

Additional arrangements of various alternate golf club head arrangements are described in FIGS. 8A-12D. These additional arrangements may be used in conjunction with some or all of the aspects described above with respect to FIGS. 1-7 without departing from the invention. Thus, the various features of the embodiments of FIGS. 1-12D can be combined to form a golf club head and golf club according to the present invention.

Figure 8A:
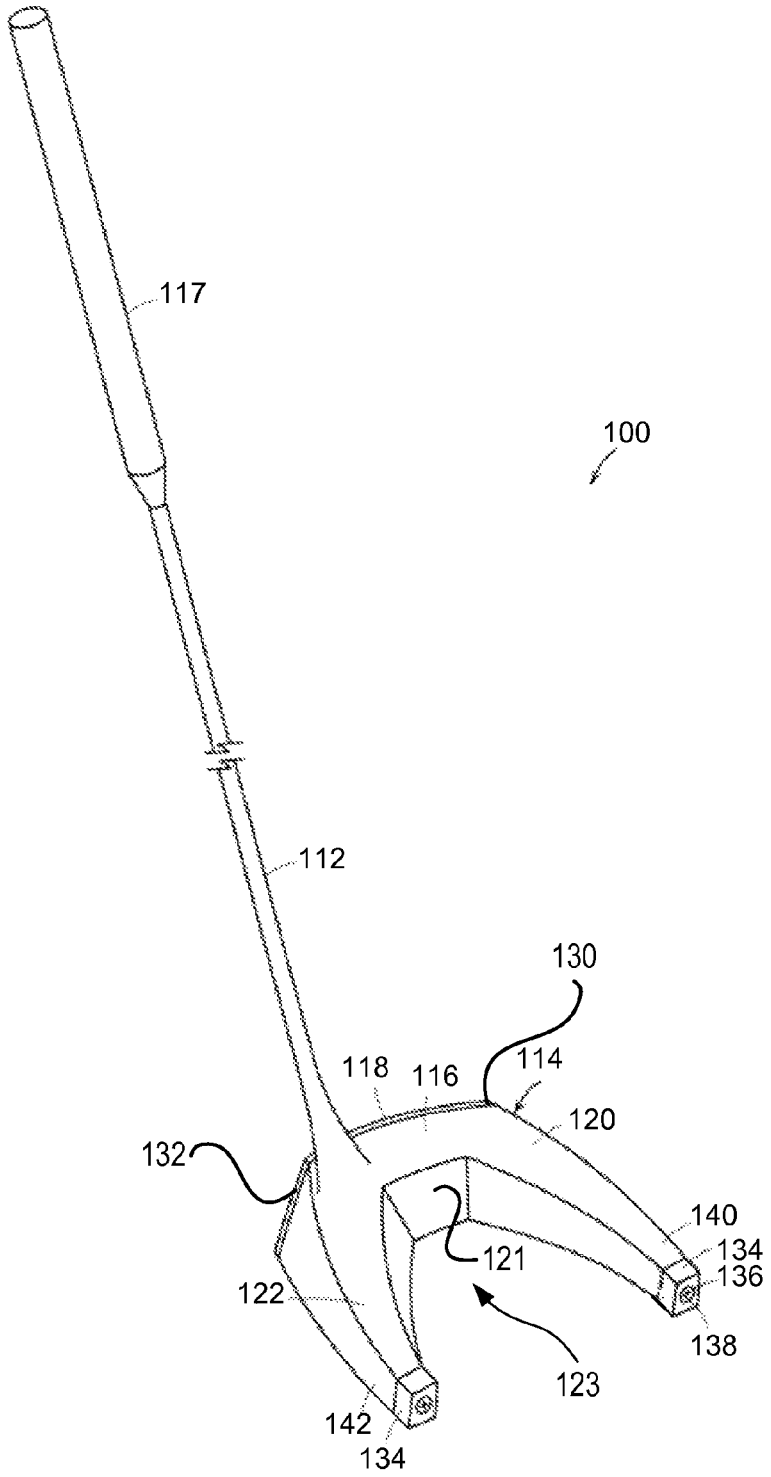
FIGS. 8A and 8B illustrate one example alternate arrangement of a golf club head in accordance with at least some aspects of this invention.
Figure 8B:
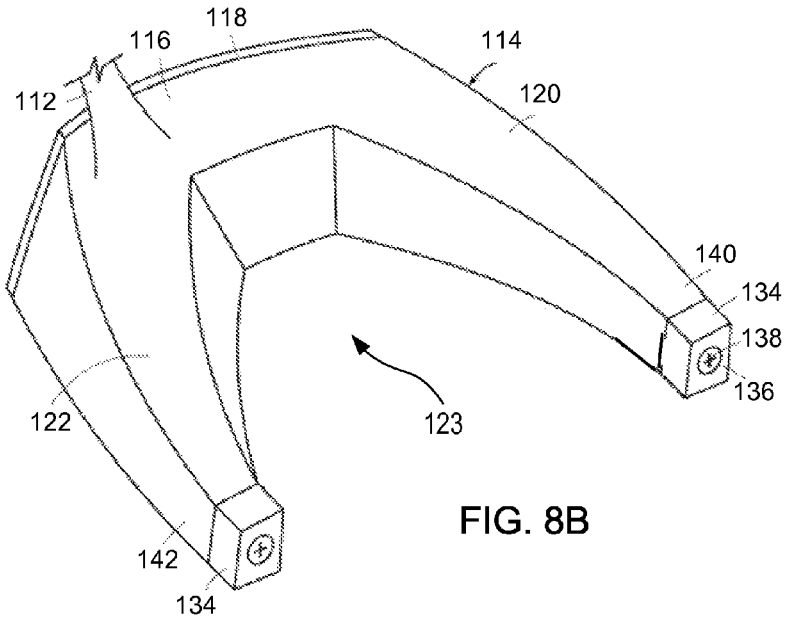

FIGS. 8A and 8B illustrate one example alternate arrangement of a golf club and golf club head structure. Similar to the arrangements discussed above, the golf club 100 includes a shaft 112 and a golf club head 114 connected to one end of the shaft. The golf club head 114 may be a wood-type golf club head, e.g., clubs and club heads typically used for drivers and fairway woods, as well as for "wood-type" utility or hybrid clubs, or the like. Although these club head structures may have little or no actual "wood" material, they still may be referred to conventionally in the art as "woods" (e.g., "metal woods," "fairway woods," etc.). The club heads described herein may include a multiple piece construction and structure, e.g., including one or more of a sole member, a face member (optionally including a ball striking face integrally formed therein or attached thereto), one or more body members (e.g., material extending around the perimeter and making up the club head body), a crown member, a face plate, a face frame member (to which a ball striking face may be attached), an aft body, etc. Of course, if desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the club head structure (such as the sole member, the crown member, the face member, the body member(s), etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a face plate member may be attached to a one piece club head aft body (optionally, a hollow body, etc.). More specific examples and features of golf club heads and golf club structures according to this invention will be described in detail below in conjunction with the example golf club structures illustrated in the Figures.

Similar to the arrangements described above, the shaft 112 may be made of any desired materials and connected to the golf club head 114 in any desired manner, including conventional materials, connected in conventional manners, as are known and used in the art. As some more specific examples, if desired, the shaft 112 may be made from steel (including stainless steel), aluminum, or other metal or metal alloy materials; graphite based materials; composite or other non-metal materials; polymeric materials, combinations of various materials, etc. The shaft 112 may be connected to a hosel area (not shown) and/or directly to the club head 114 via cements or adhesives, via mechanical connection systems, and the like. If desired, the shaft 112 may be connected to the golf club head 114 by a releasable mechanical or adhesive connection that easily allows the club head 114 and shaft 112 to be separated from one another (and optionally thereafter engaged with a different head or shaft).

A grip member 117 or other handle element may be provided on and/or integrally formed with the shaft 112. Any desired materials may be used for the grip member 117, such as rubber based materials (synthetic or natural); polymer based materials (including cord or other fabric or textile containing polymers); leather materials (synthetic or natural); etc. The grip member 117 or other handle element may be engaged with or formed as part of the shaft 112 in any desired manner without departing from this invention, including through the use of adhesives or cements, mechanical connectors (e.g., threaded connections), welding, soldering or the like. In some arrangements, the grip or handle member 117 may be integrally formed as a unitary, one-piece construction with the shaft member 112. In at least some example structures according to this invention, the grip member 117 will be made of conventional materials as are known and used in the art, and it will be attached to the shaft member 112 in conventional manners as are known and used in the art.

Club head 114 may, in some arrangements, be formed of a plurality of component parts. For instance, the golf club head 114 may include a body member 116 and a face plate 118 positioned on a front surface of the body member 116 and configured to provide a ball striking surface. In some arrangements, the face plate 118 and body member 116 may be formed separated and connected using known methods of connection, such as adhesives, cements, welding, mechanical connectors/fasteners, snap fits, and the like. In other arrangements, the face plate 118 and body member 116 may be integrally formed as a single piece.

The club head 114 may also include a first arm 120 and a second arm 122, spaced apart from first arm 120. The first arm 120 and second arm 122 may be positioned on an opposite side (e.g., rear side 121) of the body member 116 from the face plate 118 and may generally extend rearward from the body member 116 (i.e., away from the face plate 118). In some arrangements, the first arm 120 may extend from a toe edge 130 or toe portion of the golf club head 114 and the second arm 122 may extend from a heel edge 132 or heel portion of the golf club head 114. The first arm 120 has a proximate end generally at the toe edge 130 and a distal end or free end 140. Similarly, the second arm 122 has a proximate end generally at the heel edge 132 and a distal end or free end 142. The first arm 120 and second arm 122 define a space or void 123 that extends through the club head 114. The space or void is generally formed or is cooperatively defined by the body member 116, the first arm 120 and the second arm 122. In some arrangements, such as shown in FIGS. 8A and 8B, the body member 116, the first arm 120 and the second arm 122 form a substantially V-shaped club head 114. In some arrangements, the first arm 120 and second arm 122 may be tapered, such that the arms narrow as they extend toward the free end or, in some arrangements, may widen as they extend toward the free end.

Generally, the V-shaped golf club head 114 aids in distributing weight throughout the club head 114 in order to provide improved performance characteristics of the golf club head 114. For instance, the V-shape configuration may aid in distributing weight to the rear corners of the club head 114 in order to provide more forgiving golf shots. Additionally, the V-shaped club head 114 may aid in reducing the overall weight associated with the golf club head 114 by removing material associated with a conventional golf club head and instead providing a void.

In some examples, additional weights may be provided with the golf club head 114 and may be removable, adjustable, etc. For instance, FIGS. 8A and 8B illustrate one example arrangement of additional weights that may be used with the V-shaped golf club head 114. Weight members 134 may be connected to the first arm 120 and/or the second arm 122 in order to add additional weight to the rear corners of the golf club head 114 and, in particular, to the free ends 140, 142 (located at a rear of the golf club head 114) of the first arm 120 and/or the second arm 122 in order to distribute more weight to the rear of the club which may provide more lofted shots. The length, shape and mass of the weight members 134 can vary as desired.

In some arrangements, the weight members may be removably connected to the golf club head 114 and, more specifically, to the first arm 120 and the second arm 122. For instance, the weight members 134 may be connected to the first arm 120 and/or the second arm 122 using known methods of attachment such as mechanical fasteners (e.g., a screw 138), adhesives, and the like. In some arrangements, the weight member 134 may include an aperture or bore 136 through which the fastener 138 may extend to connect the weight member 134 to the golf club head 114. The weight members 134 may be removably connected in order to permit a user, etc. to remove the weight member 134 as desired or, in some arrangements, to replace the weight members 134 with weight members of different weight characteristics. For instance, a user may have multiple weight members 134 or sets of weight members 134 having multiple weight values, characteristics, etc. In some examples, sets of weight members 134 may be included in or sold together as a kit, either with the golf club or golf club head structure, or as an aftermarket product. As desired, a user may select to connect heavier weight members 134 to the golf club head 114 when more lofted shots are desired or may select lighter weight members 134 when more boring shots are desired. These removable weights members 134 provide a certain level of customization to the V-shaped golf club head 114.

In some arrangements, the weight member 134 connected to each of the first arm 120 and the second arm 122 may be different. For instance, a heavier weight may be used at the first arm 120 in order to concentrate additional weight at a toe end of the golf club head 114. Alternatively, a heavier weight 134 may be connected to the second arm 122 in order to concentrate additional weight near a heel of the golf club head 114. Various other weight combinations and arrangements may be used without departing from the invention.

In some arrangements, the weight members 134 may be longer than the length illustrated in FIGS. 8A and 8B. That is, additional weight may be added to the golf club head 114 by providing longer weight members 134 that may further distribute weight to the rear corners of the golf club head 114.

Figure 9:
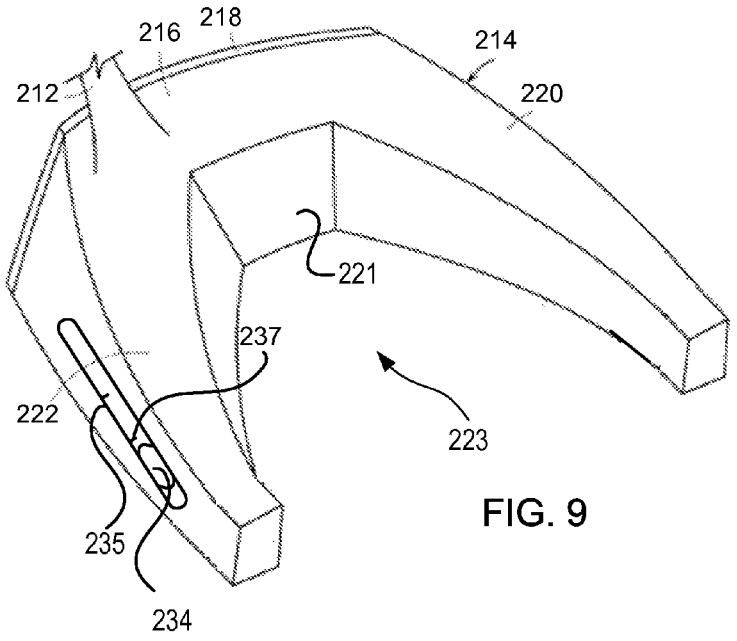
FIG. 9 illustrates another example alternate arrangement of a golf club head having in accordance with at least some aspects of this invention.

FIG. 9 illustrates another alternate arrangement of a V-shaped golf club head 214. The golf club head 214 of FIG. 9A includes a body member 216, as well as a first arm 220 and a second arm 222 that extend rearward from the body member 216, similar to the arrangements discussed above. The body member 216, the first arm 220 and the second arm 222 cooperatively define a void 223 in the rear region of the golf club head 214 and form the generally V-shaped golf club head 214. In some examples, the V-shaped golf club head 214 may include one or more additional weight members 234 that may, in some arrangements, be adjustable. For example, FIG. 9 includes an adjustable weight member 234 that is arranged in an opening in the form of a slot or groove 235 formed in the second arm 222 of the golf club head 214. In some arrangements, a similar slot or groove and adjustable weight member may be formed in the first arm 220 (not shown in FIG. 9A). In further exemplary embodiments, the both the first arm 220 and the second arm 222 can have a groove to accept adjustable weight members. The slot or groove 235 may generally be a recess or any other form of cavity formed in the arm 222 (for instance, during manufacture, post-processing, etc.) that is configured to receive an adjustable weight member 234. The recess may, in some arrangements, have a substantially rectangular cross section, square cross section, semi-circular cross-section, and the like.

The adjustable weight member 234 may, in some arrangements, such as shown in FIG. 9, be a weight configured to fit within the slot 235 and that may be slidable along the slot 235 in order to adjust the position of the adjustable weight member 234. In some arrangements, the adjustable weight member 234 may be formed of a material heavier than the remainder of the golf club head 214, or portions thereof. In other arrangements, the adjustable weight member 234 may be formed of the same material as the remainder of the golf club head 214, or portions thereof. In some examples, the adjustable weight member 234 may be formed of steel, aluminum, titanium, magnesium, tungsten, graphite, or composite materials, as well as alloys and/or combinations thereof.

The adjustable weight member 234 may be movable or slidable within the slot 235, as discussed above. Additionally, the slot 235 may include one or more stops 237 configured to hold the adjustable weight member 234 in a desired location within the slot 235. The stops 237 may be formed of metal, plastic, rubber, and the like and the adjustable weight member 234 may be arranged to move over the stop 237 with the application of sufficient force to overcome the stop 237. Thus, in one exemplary embodiment, the stops 237 may have resiliently deflectable characteristics such that a weight member 234 can be moved along the slot 235 and securely held at different locations of the slot 235.

The adjustable weight member 234 may, in the arrangement of FIG. 9, be moved forward (i.e., toward the front face plate 218 of the golf club head 214) or rear ward (i.e., toward the free ends of the first arm 220 and/or second arm 222). This distribution of weight to the front or rear of the golf club head 214 may aid in providing varying performance characteristics for the golf club head 214. For instance, the adjustable weight member 234 may be moved forward to provide more boring shots, such as those desired in high wind conditions, while the adjustable weight member 234 may be moved rearward to provide more lofted shots, as desired.

It should be noted that, although the slot 235 and adjustable weight member 234 are shown on an outer side of the second arm 222, the slot 235 and adjustable weight 234 may be arranged on an interior side of the second arm 222, i.e., the side adjacent the void, without departing from the invention. The slot 235 could also be positioned on a top side or bottom side of the second arm 222. Additionally or alternatively, a similar slot and adjustable weight member may be arranged on a rear side 221 of the body member 216 and may provide optional weight distribution from a toe of the golf club head 214 to a heel of the golf club head 214. In configurations where the golf club head 214 has a slot 235 in both the first arm 220 and the second arm 222, the number of adjustable weight members as well as the particular placement of the adjustable weight members in the slots 235 in each arm 220, 222 can be varied to provide enhanced customizable weighting characteristics for the golf club head 214.

Figure 10A:
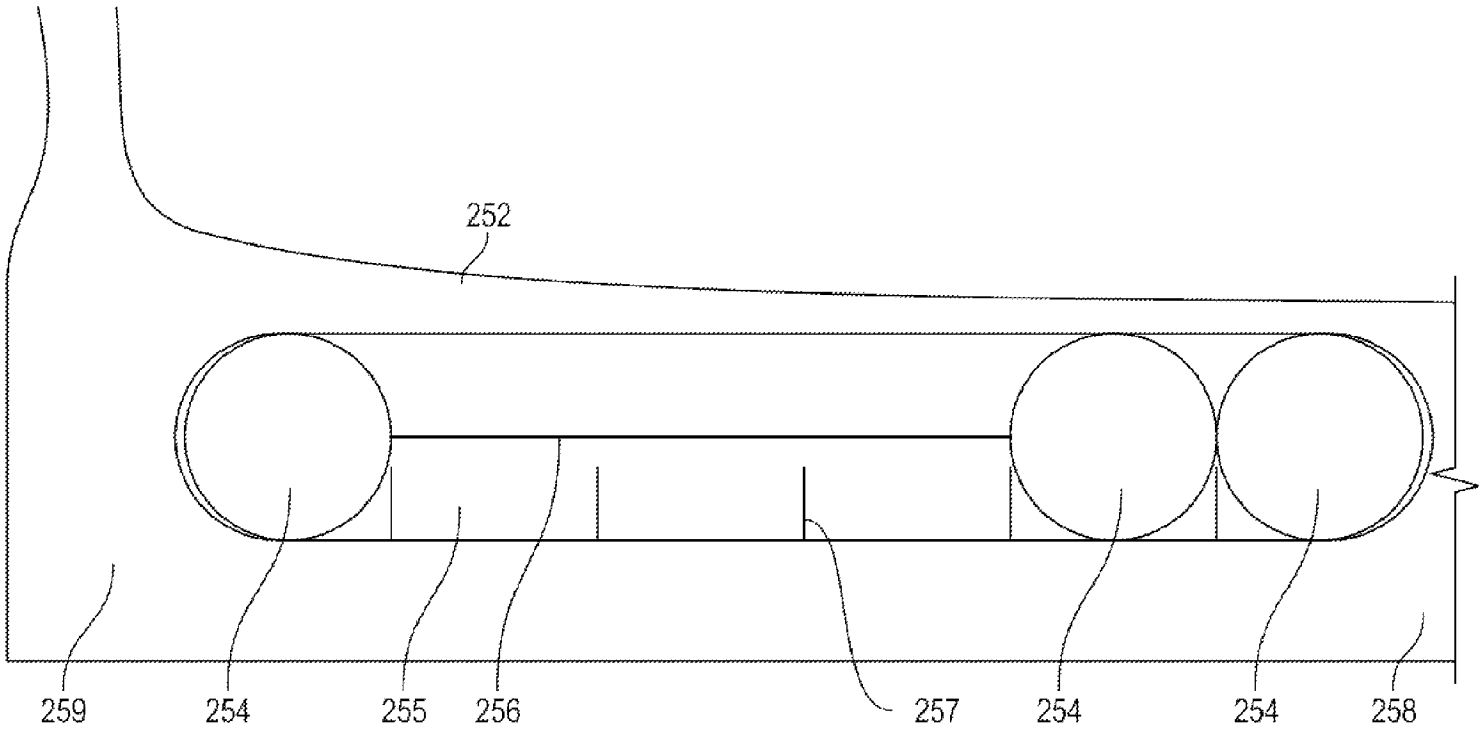
FIGS. 10A and 10B illustrate alternate arrangements of the slot and adjustable weight member shown in FIG. 9 in accordance with at least some aspects of this invention.
Figure 10B:
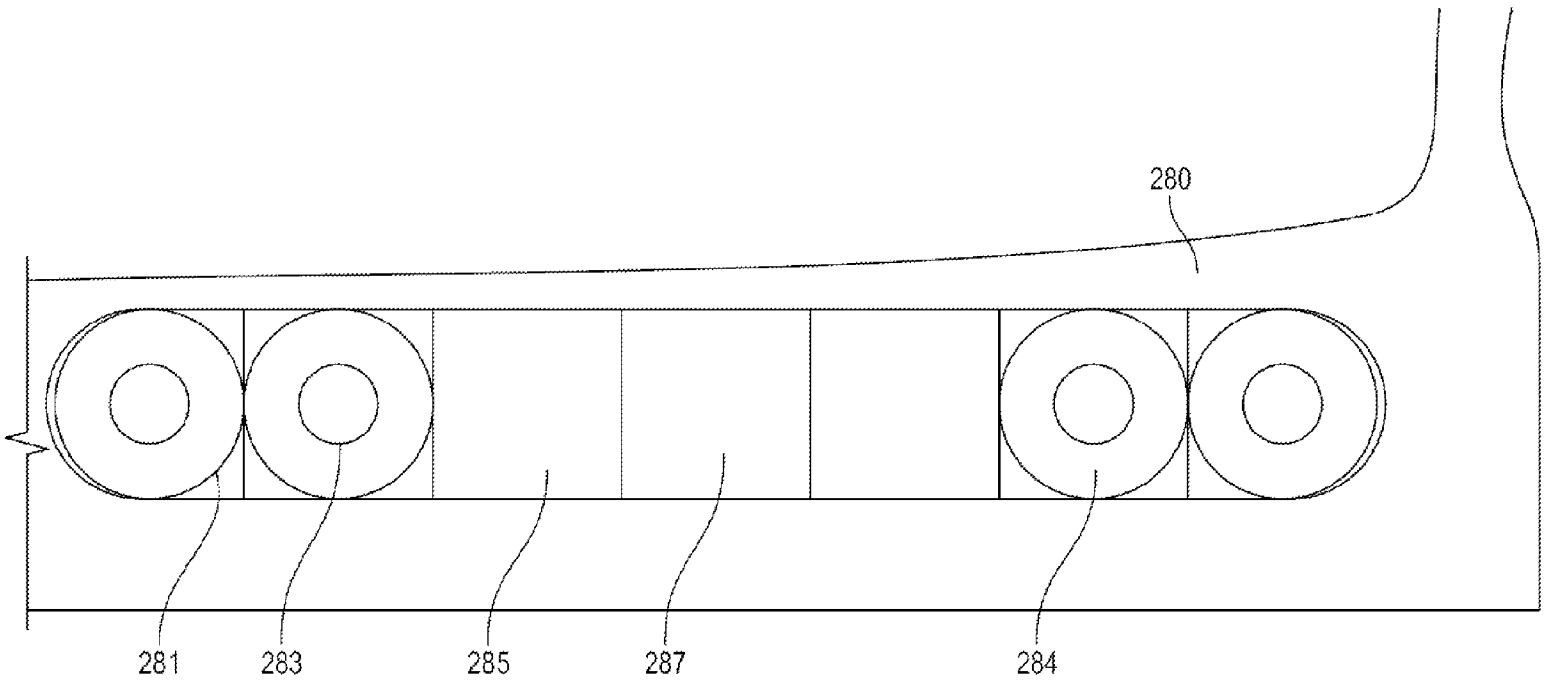

For instance, FIGS. 10A and 10B illustrate alternate arrangements of the adjustable weight member configured within a slot. The slot and weight members shown are enlarged to show detail associated with the adjustable weight member and slot. However, the slot may be sized to fit within the arm of the golf club head and nothing in the figures should be construed as limiting the size of the slot.

FIG. 10A illustrates one alternate adjustable weight member arrangement. Similar to the arrangement of FIG. 9, the slot 255 is formed on an outer surface of second arm 252. Further, slot 255 generally includes stops 257 that may be configured to maintain the position of the adjustable weight members 254 within the slot 255. Similar to the arrangement described above, the stops 257 may be formed of a resiliently deflectable material, such as rubber, polymer, and the like in order to maintain the position of the adjustable weight member 254 within the slot, while permitting movement of the adjustable weight member 254 along the slot, i.e., by sliding the adjustable weight member 254 over the stop 257 and forcing it to deflect.

In the arrangement of FIG. 10A, a plurality of adjustable weight members 254 are shown. More or fewer adjustable weight members may be used without departing from the invention. The adjustable weight members 254 are arranged along a rod or rack 256 which may be positioned within the slot or groove 255. The adjustable weight members 254 are configured to slide along the rod 256 to a desired position along the slot 255. The adjustable weight members 254 may each have substantially the same or similar weight characteristics or may have different weight characteristics. The adjustable weight members 254 may slide along the rack 256 within the slot 255 to adjust the weight distribution associated with the golf club head. For instance, if additional weight is desired in the rear of the club, a majority or a predetermined number of adjustable weight members 254 may slide to the rear of the club, e.g., proximal end 258. Alternatively, if additional weight is desired near a face of the golf club head, some or all adjustable weight members 254 may slide toward the face of the club, i.e., end 259. In some arrangements, all adjustable weight members 254 may slide to one end or the other. In still other arrangements, the adjustable weight members 254 may be distributed along the length of the slot 255.

FIG. 10B illustrates another example adjustable weight member and slot arrangement. Similar to the arrangements discussed above slot 285 is formed in an arm of the golf club head. In this arrangement, the slot 285 is formed in the first arm 280. The slot 285 may be sized and arranged similar to the arrangement described above. The slot 285 includes a plurality of removable weight members 284. In some examples, the removable weight members 284 may include an internal weight 283 formed of a desired weighting material such as steel, tungsten, and the like. The internal weight 283 may be surrounded by a cover 281 to form the removable weight member 284. The cover may be formed of a resiliently deflectable material in order to permit the removable weight members 284 to be inserted into the slot 285. For instance, the cover 281 may deflect as the removable weight member is inserted into or removed from the slot but then may return to its original shape once within the slot in order to maintain the position of the removable weight 284 within the slot 285.

In some examples, the slot 285 may include a plurality of segments or compartments 287. These segments 287 may be configured to receive one or more removable weight members 284 and maintain the position of the removable weight member 284 within the slot 285. In some arrangements, the walls forming the segments may be formed of a lightweight material, such as aluminum, titanium, various polymers, and the like.

The removable weights 284 may be of substantially the same or similar weight characteristics or may have different weight characteristics. Accordingly, as desired, one or more removable weights 284 may be inserted into the slot 285 in order to adjust the weight distribution associated with the golf club head.

In still other example slot arrangements, a slot may include a bias member that a weight member may be forced against to fit into the slot. The bias member may then maintain the position of the weight member by providing a force on the weight member.

In some examples of various slot arrangements that may be used in accordance with various aspects of this invention, the slot may be covered in order to prevent dirt and/or debris from collecting within the slot. Although some examples described herein include weights arranged within a slot, weights may, in some alternative arrangements, be positioned in a single location. For instance, a weighted portion may be formed in one or more arms during manufacture. Additionally or alternatively, weights may be positioned at a point along one or more arms (such as the end (as described herein in some examples), at a point along the length of the arm, etc.). The weights may, in some examples, be removable and/or replacement with weights having different weight values.

Figure 11A:
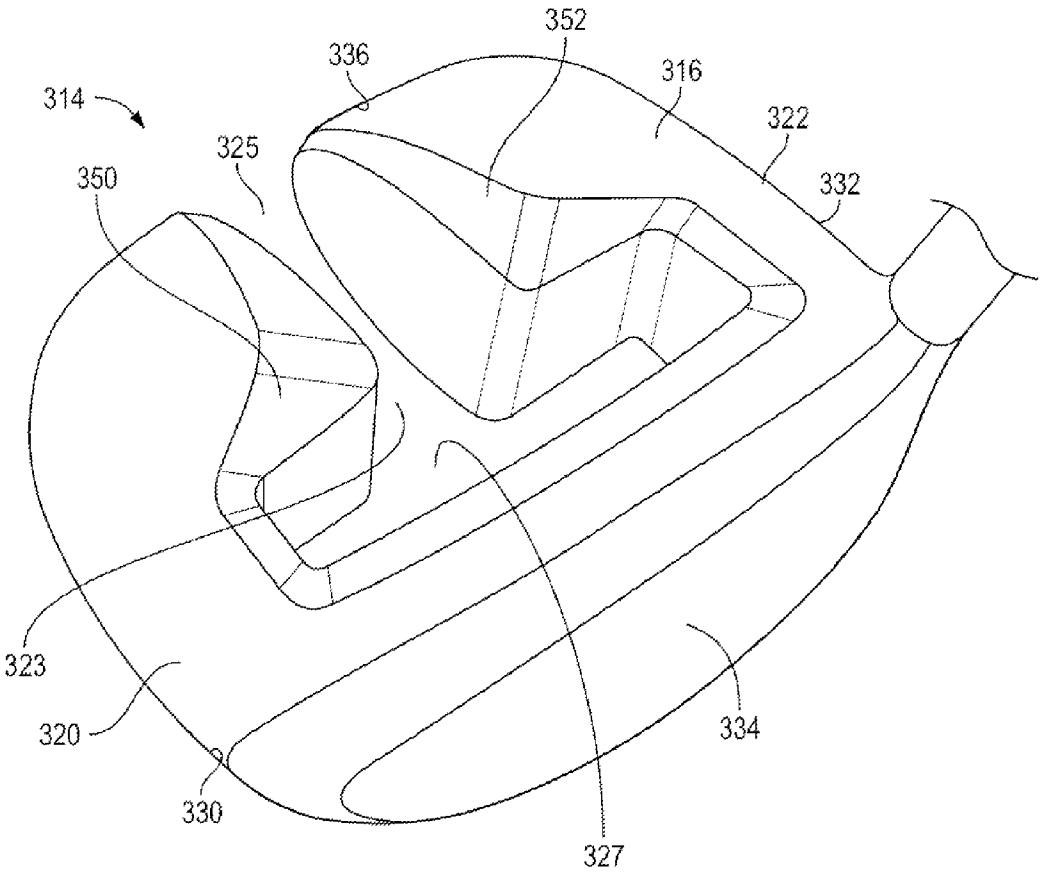
FIGS. 11A-11C illustrate yet another example golf club head arrangement according to at least some aspects of this invention.
Figure 11B:
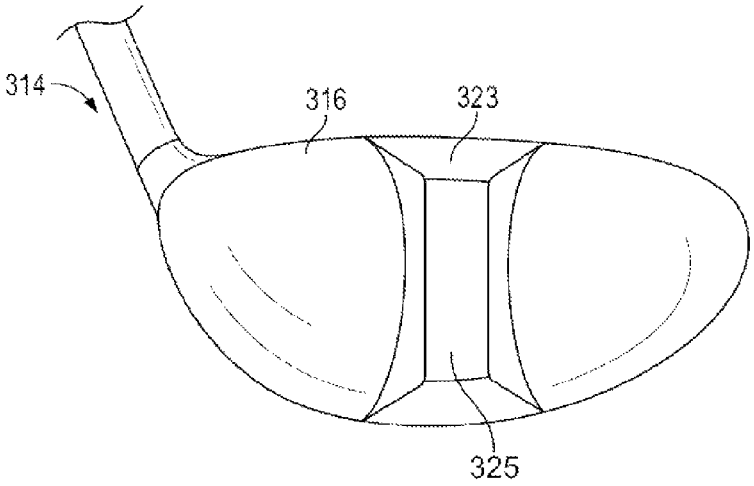
Figure 11C:
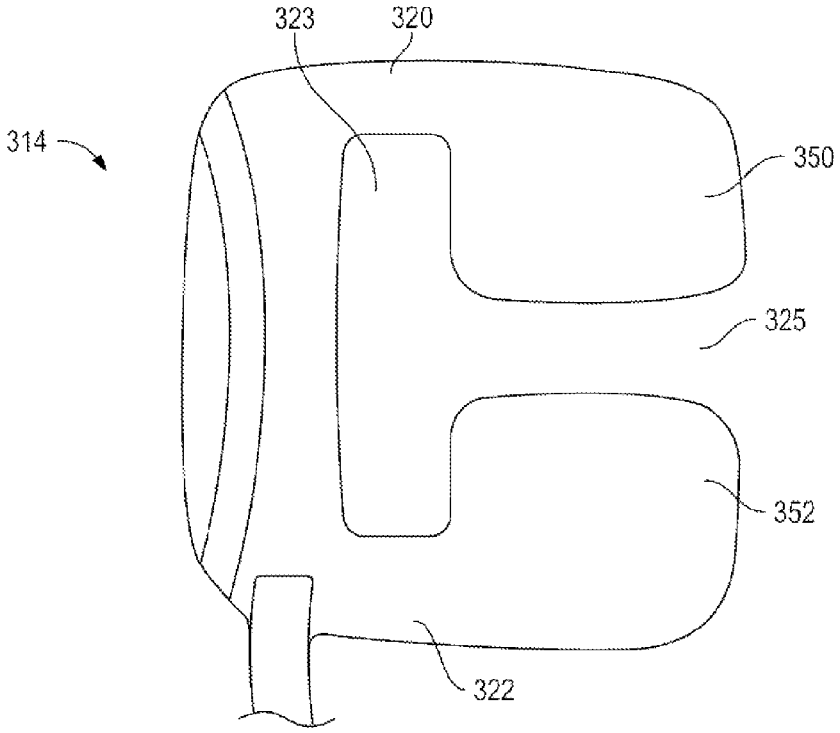

FIGS. 11A-11C illustrate another alternate arrangement of a golf club head 314 according to aspects described herein. The golf club head 314 includes a golf club head body 316. The golf club head body 316 generally includes a toe portion 330, a heel portion 332, a front face 334 and a rear portion 336. As shown in FIG. 11A, a portion of the golf club head body 316 is removed and a void 323 is created within the remainder of the golf club head 314 and defined by the remainder of the golf club head 314. This removal of a portion of the golf club head body 316 aids in reducing weight associated with the golf club head 314. In addition, removing weight at or near a center of the club head body 316 aids in distributing weight to the rear and/or outer perimeter of the golf club head 314 in order to provide improved performance characteristics. It is understood that the golf club head body 316 of FIGS. 11A-11C may be a solid construction or a hollow construction as desired.

As shown in FIG. 11A, as well as the rear view shown in FIG. 11B and the top view of FIG. 11C, the rear portion 336 of the golf club head 314 includes an opening 325 extending through the golf club head body 316. In some arrangements, the opening 325 may be between 1 and 4 inches wide. The opening 325 may extend from the edge of the rear portion 336 and into a central region 327 of the golf club head body 316 in order to reduce weight associated with the central region 327 of the golf club head body 316. The opening 325 is thus in communication with and may be considered part of the void 323. In some arrangements, the void 323 formed in the golf club head body 316 may form a T-shape. That is, the opening 325 may extend into the central region 327 of the golf club head body 316 and then communicate with an opening that extends toward the toe portion 330 and heel portion 332 of the golf club head 314. In such a configuration as shown in FIG. 11A, the void 323 is generally T-shaped. As further shown in FIGS. 11A-11C, the golf club head 314 has a first arm 320 and a second arm 322 that extend rearwardly from the front face 334 of the club. At a distal end or free end of the first arm 320, the first arm 320 has a first inwardly extending member 350. Similarly, at a distal end or free end of the second arm 322, the second arm 322 has a second inwardly extending member 352. The first inwardly extending member 350 and the second inwardly extending member 352 are spaced from one another and positioned in confronting relation wherein the opening 325 is defined between the members 350, 352. This arrangement aids in distributing weight associated with the golf club head 314 to the perimeter of the golf club head 314 and, additionally, toward the rear and/or rear corners of the golf club head.

In some examples, the weight associated with the portion of the golf club head removed to form the void may be between 15 g and 50 g. In still other examples, the amount of material removed to form the void may comprise 5% to 30% of the area or mass of the club head.

Figure 12:
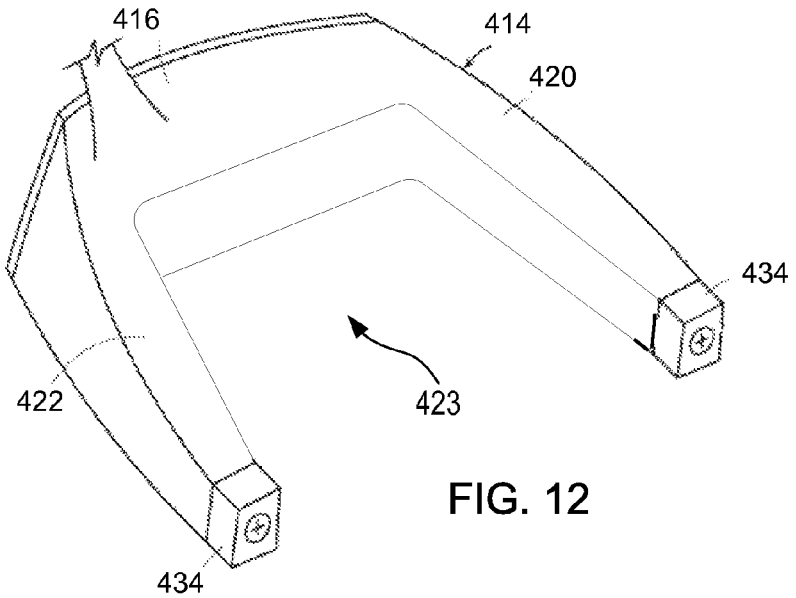
FIGS. 12 and 13 illustrate another example golf club head arrangement according to at least some aspects of this invention.
Figure 13:
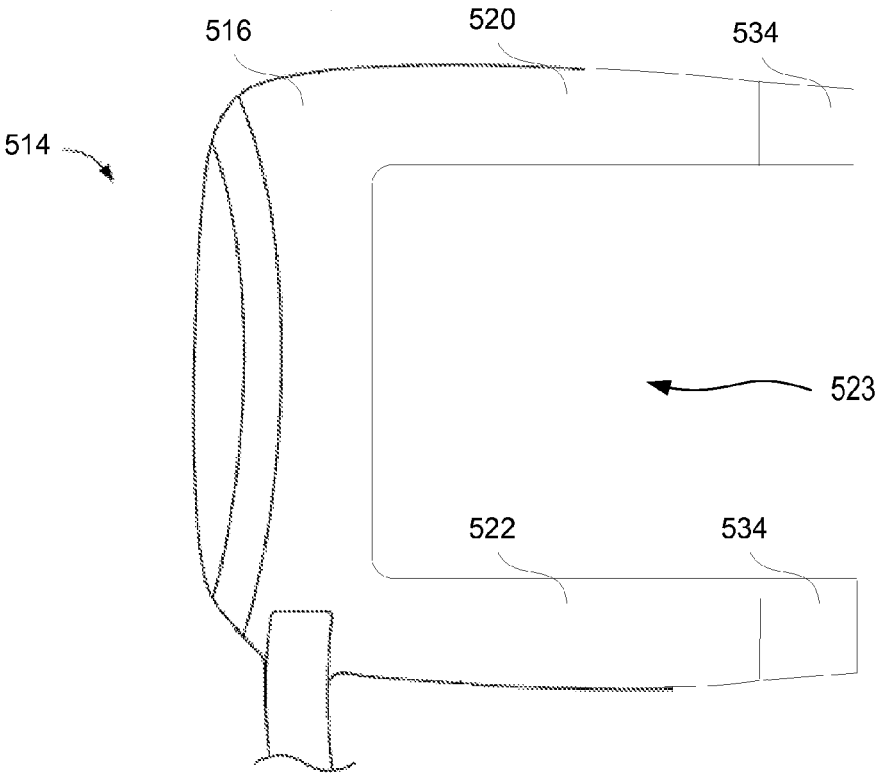

FIGS. 12 and 13 illustrate yet another alternate arrangement of a golf club head as described herein. FIG. 12 is a perspective view of golf club head 414 while FIG. 13 is a top view of golf club head 514. The golf club heads 414, 514 shown generally include a club head body 416, 516, as well as a first arm 420, 520 and a second arm 422, 522 that extend rearward from the body member 416, 516, similar to some arrangements discussed above. The body member 416, 516, the first arm 420, 520 and the second arm 422, 522 cooperatively define a void 423, 523 in the rear region of the golf club head 414, 514, respectively, similar to void 123 in FIGS. 8A and 8B, and 223 in FIG. 9. In some examples, the void 423, 523 formed in the rear region of the golf club head 414, 514 may be substantially square or rectangular shaped. That is, the rear edge of the golf club head 414, 514 may include an opening between the arms. The opening may extend into the rear of the golf club head 414, 514 and, in some arrangements, the width of the opening may be constant from the rear edge of the golf club head 514 to an end surface of the void, as shown in FIG. 13. In other examples, the width of the void may be non-constant. For instance, the void 423 of FIG. 12 may have a slight taper while maintaining the substantially square or rectangular shape. Similar to the arrangements described above, the substantially square or rectangular shaped void may aid in reducing overall weight associated with the golf club head.

Similar to some arrangements described above, the golf club head 414, 514 may include one or more adjustable weight members 434, 534. FIGS. 12 and 13 illustrate adjustable weight members 434, 534 positioned at an end of each arm. These weights 434, 534 may be removably connected to the arms and interchangeable with weights having differing weight values. Alternatively, other adjustable weight arrangements, such as those described above with respect to FIGS. 9, 10A and 10B, etc. may be used in conjunction with the substantially square or rectangular void arrangement shown in FIGS. 12 and 13.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A hollow golf club head, comprising:

a hollow golf club head body having a front face, a rear face located opposite the front face, a toe edge and a heel edge;

a first arm extending rearward from the rear face of the golf club head body and from the toe edge to a first free end;

a second arm extending rearward from the rear face of the golf club head body and from the heel edge to a second free end; and a movable weight positioned within at least one of the first arm and the second arm; wherein the movable weight is slidable within a slot formed on an exterior side of at least one of the first arm and the second arm.

2. The golf club head of claim 1, wherein the golf club head body, first arm and second arm define a void in the golf club head.

3. The golf club head of claim 2, wherein the void is substantially V-shaped.

4. The golf club head of claim 2, wherein the void is substantially rectangular.

5. A hollow golf club head, comprising:

a hollow golf club head body having a front face, a rear face located opposite the front face, a toe edge and a heel edge;

a first arm extending rearward from the rear face of the golf club head body and from the toe edge and having a distal end free of attachment to any other member;

a second arm extending rearward from the rear face of the golf club head body and from the heel edge and having a distal end free of attachment to any other member; and a movable weight positioned within at least one of the first arm and the second arm, wherein the golf club head body, first arm and second arm form a substantially V-shaped golf club head.

6. The golf club head of claim 1, wherein the golf club head is connected to a shaft forming a golf club.

7. A golf club head, comprising:

a golf club head body having a front face, a rear edge, a toe edge and a heel edge; and a void formed in a central region of the golf club head body and extending from a rear edge inward, toward the front face of the golf club head body, the void extending entirely through the golf club head body, wherein the void comprises between 5% and 30% of the area of the golf club head.

8. The golf club head of claim 7, wherein the void is substantially T-shaped and extends from the rear edge toward the central region of the golf club head body and from the central region toward the toe edge and heel edge.

9. The golf club head of claim 7, wherein the void includes an opening in the rear edge that is between 1 and 4 inches wide.

10. The golf club head of claim 7, wherein the void is defined by the golf club head body.

* * * * *